US005452476A

United States Patent [19]

Jenks

[11] Patent Number: 5,452,476

[45] Date of Patent: Sep. 26, 1995

[54] ANORAK ATTACHED TO BELT POUCH FOR EASY DEPLOYMENT AND USE WITH A BACKPACK

[76] Inventor: Kenneth Jenks, 7088 Blue Hill Dr., San Jose, Calif. 95129

[21] Appl. No.: 186,774

[22] Filed: Jan. 26, 1994

[51] Int. Cl.[6] ..... A41D 27/12; A41D 1/02

[52] U.S. Cl. ..... 2/46; 2/93; 2/108; 2/94; 2/311; 2/69

[58] Field of Search ..... 2/94, 93, 46, 108, 2/311, 312, 69

[56] References Cited

U.S. PATENT DOCUMENTS

| | | |
|---|---|---|
| 351,549 | 10/1886 | Weimer . |
| 1,537,119 | 5/1925 | Keplinger . |
| 2,074,012 | 3/1937 | Bour . |
| 2,320,783 | 6/1943 | Lee . |
| 2,873,449 | 2/1959 | Herbert . |
| 3,389,407 | 6/1968 | Morrison . |
| 3,670,340 | 6/1972 | Walker . |
| 4,217,663 | 8/1980 | Goldberg . |
| 4,404,687 | 9/1983 | Hager . |
| 4,606,078 | 8/1986 | Tkacsik . |
| 5,040,243 | 8/1991 | Tatsumo . |
| 5,077,838 | 1/1992 | Senser ..... 2/94 |
| 5,123,117 | 6/1992 | Prendergast . |
| 5,165,111 | 11/1992 | Liberman . |

FOREIGN PATENT DOCUMENTS

| | | |
|---|---|---|
| 2177284 | 1/1987 | United Kingdom ..... 2/108 |

*Primary Examiner*—C. D. Crowder
*Assistant Examiner*—Glona Hale
*Attorney, Agent, or Firm*—Phillips, Moore, Lempio & Finley

[57] ABSTRACT

A garment and method for its use, a covering such as a poncho or an anorak, designed to enable a backpacker to don the covering while he or she is wearing a backpack. The garment incorporates a belt with an integrally-formed pouch where the covering garment is stored. The pouch is worn about the waist of the user with the pouch at the front. Where the garment is an anorak, it is open in the back. To use, the user unfolds the garment from the pouch and dons the garment from the rear. There is a slide fastener in the back of the unfurled garment, allowing the user to close the back of the garment after it has covered the backpack.

13 Claims, 7 Drawing Sheets

ANORAK ATTACHED TO BELT POUCH FOR EASY DEPLOYMENT AND USE WITH A BACKPACK

BACKGROUND OF THE INVENTION

This invention relates generally to protective rain garments or coverings, more specifically it refers to "covering garments," such as an anorak to be used with a backpack or rucksack, which is also useful for its easy deployment when used without a backpack.

Conventional garments for use with a backpack are generally used to repel rain or to keep the user warm. Many of these covering garments are characteristically stored separately from any integral pouch within a garment, which is inconvenient because the user must stop and retrieve them from storage before donning them when inclement weather threatens. Other configurations of these covering garments have the covering garment stored and attached to an integral pouch within a jacket or vest, to be unfurled to cover only the jacket or vest itself, to make it water-proof. Still other configurations of these garments have the garment itself as an integral part of the backpack. These would be stored attached to a pouch within the backpack itself, to be unfurled and closed around the backpack by the user when inclement weather threatens.

A problem with these conventional garments is that a backpacker is compelled to stop and remove the backpack before donning the garment. This is always inconvenient and could be hazardous if the backpacker is already in a precarious position.

Another problem with many of these conventional covering garments is that they can not simultaneously protect a backpacker and his backpack from moisture. Many of the prior art configurations are for covering the user alone, inherently too small to fit over both the user and any part of the backpack.

A related problem with conventional garment coverings is the difficulty with which they are donned by a person in the seated position. There are occasions when rising from a seat can be awkward or impossible, such as when a spectator is at an outdoor sports arena event, or when a person is confined to a wheelchair.

SUMMARY OF THE INVENTION

The present invention is directed to a covering garment that satisfies the above needs to have a garment that can protect both the user and the user's backpack, while not requiring the user to remove the backpack before donning the covering garment. The invention further satisfies the need to have a garment which can be donned by a person while remaining in the seated position.

In one embodiment, there is provided a belt having a pouch which is worn at the hips, with the pouch at the front of the user. A covering garment is stored within and attached to the pouch.

The method of unfolding and donning the garment is straightforward: in the case of a person with a backpack, the user extracts the covering from the pouch at front, opens it and covers both the user and all or a portion of the backpack. In the case of a seated person, such as a spectator seated at an event or a person in a wheelchair, where it would be awkward or impossible to stand, the user simply removes the stored garment in the pouch from his lap and leans forward, then covers the front and back of the torso, and perhaps some or all of the seat.

The preferred embodiment also includes a belt having an integrally-formed pouch to be worn at the front. The rear portion of the belt is also in itself a smaller pouch for storing miscellaneous items. The front pouch contains an anorak type of covering garment, which is attached to the interior of the front pouch. The belt is worn about the waist of the user with the pouch containing the anorak at the front.

The anorak is open in its back, closeable by means of a slide fastener or similar conventional fastening device. The user unfolds the anorak from the pouch, slips his arms through the sleeves and puts his head through the hole delineated by the collar. The slide fastener in the back of the unfurled anorak, has a lanyard attached to the slide. After donning the anorak the user reaches behind himself and pulls downwardly on the lanyard, closing the rear of the anorak over both himself and, if he is wearing a backpack, some or all of the backpack.

The preferred embodiment is also equipped with a clasp, whose halves are at either side of the lower end of the slide fastener in the back of the anorak. The clasp can be used to secure the anorak about a backpack when the size of the anorak is not large enough to allow the slide fastener to be closed over the backpack.

The collar of the anorak is itself also a pouch, having a slide fastener along the outside of the collar, which contains a hood which is attached to the interior of the collar. The user can unfurl and wear the collar over his head for protection from moisture.

Accordingly, it is an object and advantage of the invention to provide a new and novel method for conveniently storing and donning a covering garment which can be donned by a backpacker without having to first remove his backpack.

It is another object and advantage of this invention to provide a new and novel method for conveniently storing and donning a covering garment for use by seated person which can be donned without having to first rise from the seat.

It is yet another object of the invention to provide a covering garment, having a storage pouch worn in the front, which can be donned by a backpacker without having to first remove his backpack.

It is yet another object of the invention to provide a covering garment which can be donned from the front by a seated user, without having to first stand up from a seated position.

These and other features, aspects and advantages of the present invention will become better understood with regard to the following description, appended claims and accompanying drawings detailing the preferred embodiment.

DESCRIPTION OF THE INVENTION

Method of Use

Figure 1:
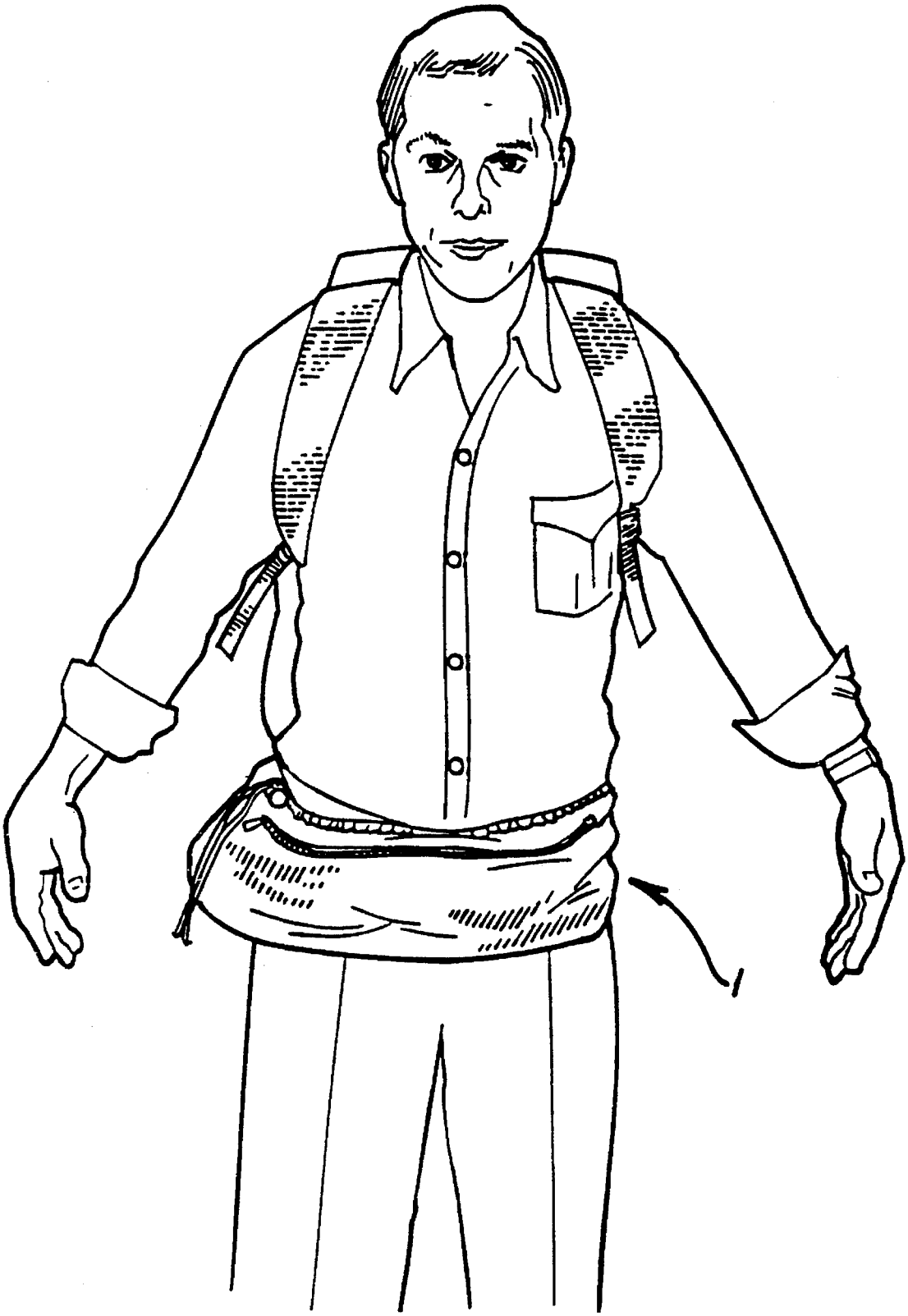
FIG. 1 is a front view of a backpacker wearing the current garment in the stored configuration with the covering garment inside the pouch shown.

Referring now to the drawings in general and particularly to FIG. 1, the method of use of the current invention can be illustrated. There is shown a figure wearing the preferred embodiment of the present inventive garment/pouch 1, being worn in the stored configuration.

Figure 3:
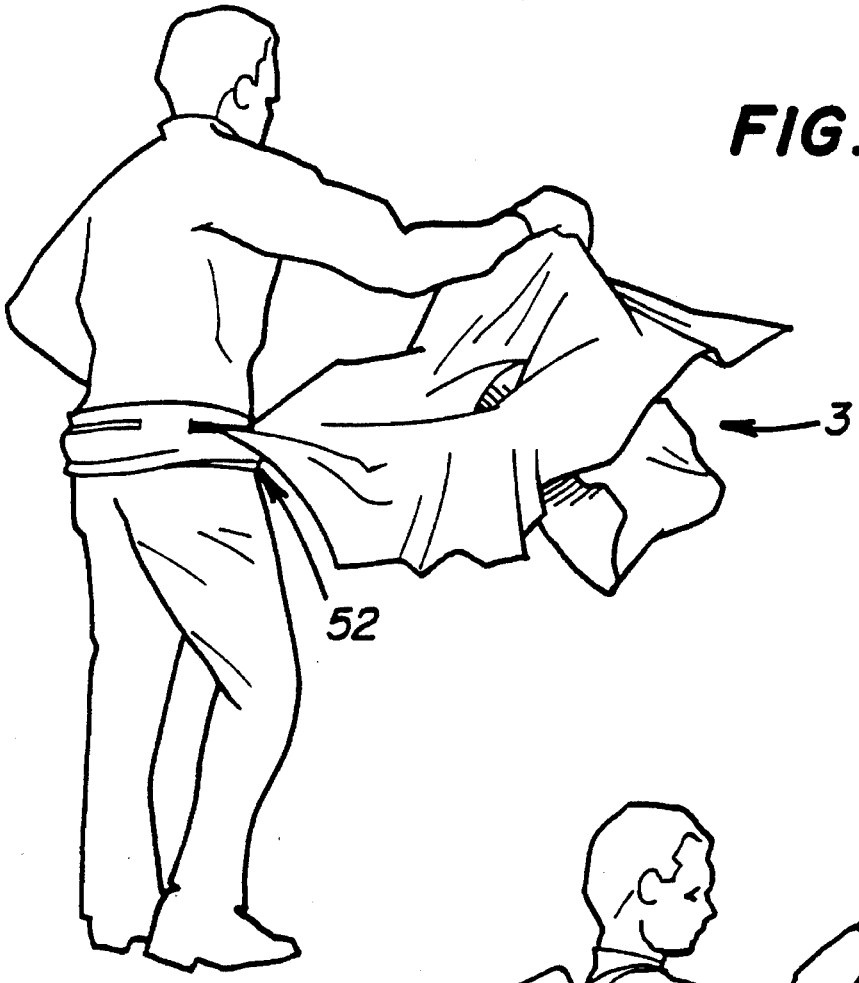
FIG. 3 is a side view of a figure wearing a backpack removing an alternative embodiment of the garment from storage for use.
Figure 2:
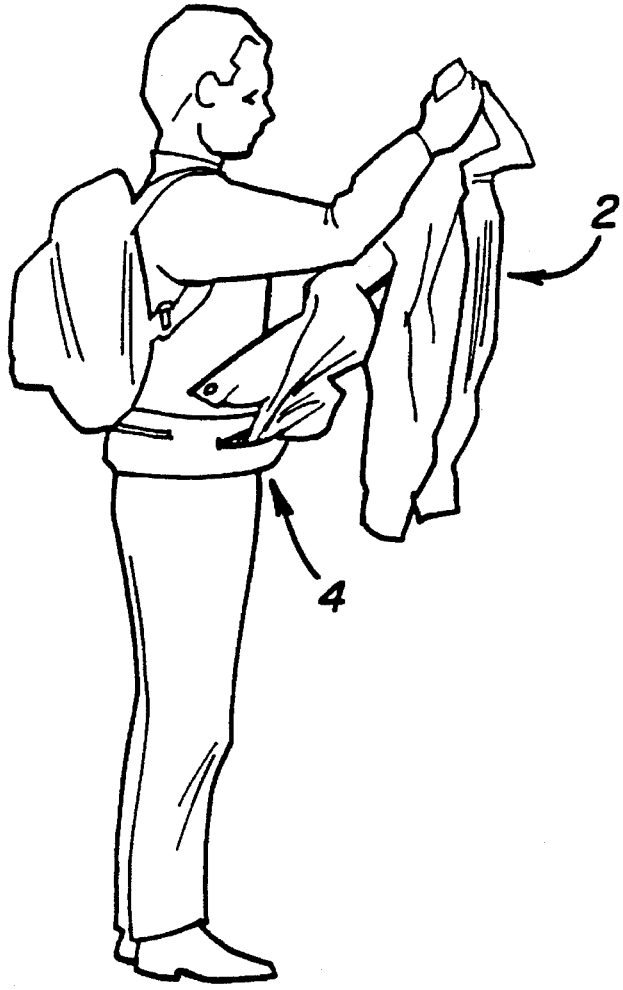
FIG. 2 is a side view of a figure removing the preferred embodiment of the garment for use.

Referring now to FIG. 2, the user first withdraws the anorak 2 from the front pouch 4, in preparation to don the garment. It should be noted that the method of the current invention is not limited to the apparatus of the preferred embodiment of the invention. For instance, FIG. 3 shows that the pouch could store one of many types of a covering garment 3, here a common poncho of a type well known in the art. Lastly the user places the covering garment 3 over his head and, if he is carrying a backpack, over the backpack too.

The above method could also be used for easily covering a user when he is sitting in a chair, without a backpack. The user need simply lean forward, to allow the covering garment 3 to pass between the user's back and the back of the chair, don the covering garment, then resume the normal seated position leaning against the seat back.

The Garment

Figure 4:
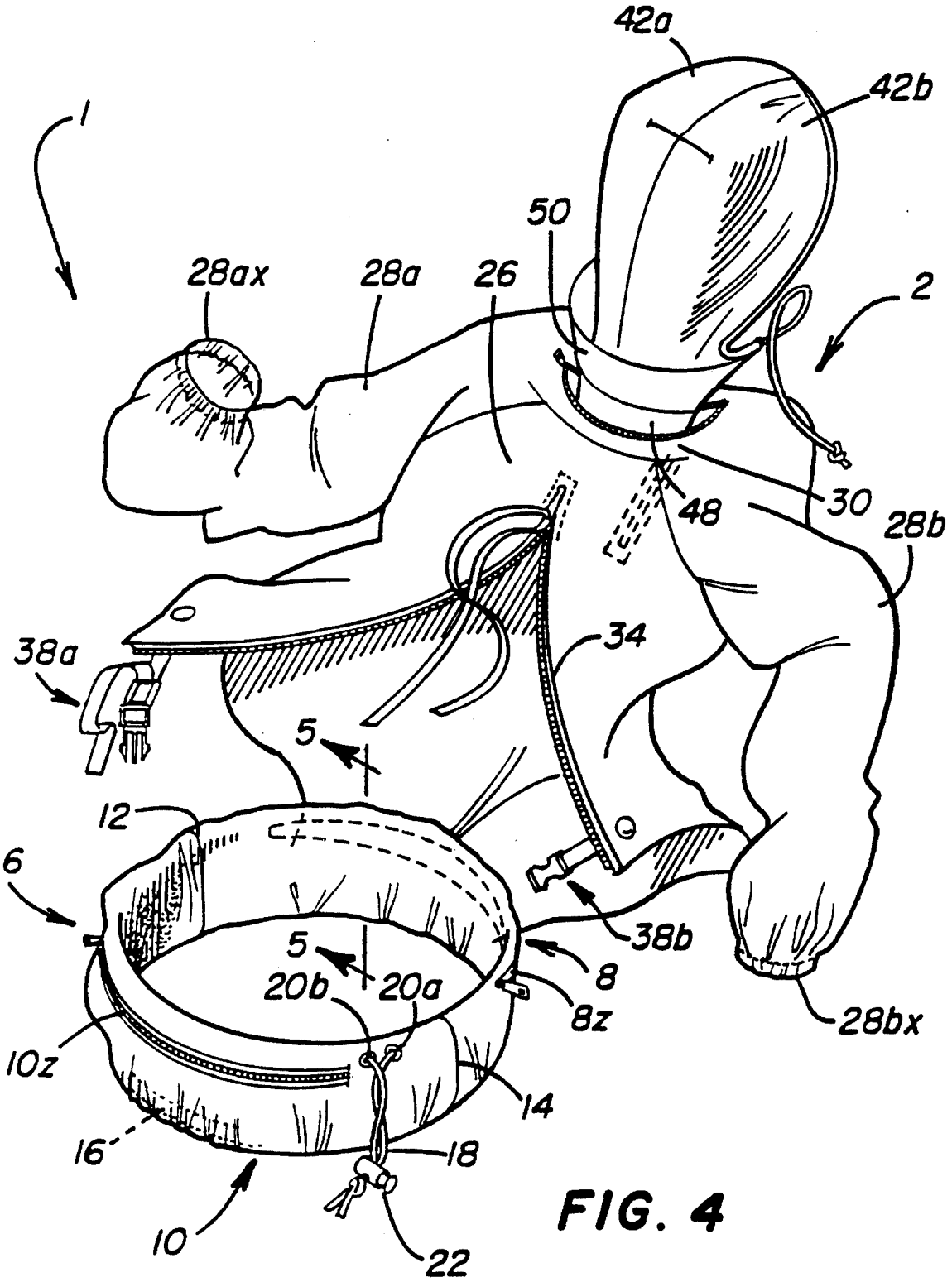
FIG. 4 is a rear view of the preferred embodiment of the invention, removed from storage and standing alone.

Referring now to FIG. 4, the preferred embodiment of the invention 1 is shown from the rear, unfolded and standing alone. The belt section 6 itself forms two pouches, a front pouch 8 in which the anorak 2 is stored and a rear pouch 10 in the back for storage of miscellaneous items, such as maps.

The belt section 6 is formed from one piece of fabric fashioned in a toroidal (doughnut) shape. The fabric is first formed in a tubular shape by sewing together a rectangular piece of fabric along its lengths. The width ends of the toroid are then sewn pinched together by joining seam 12. On the side of the toroid opposite the joining seam 12, the width of the fabric is similarly sewn pinched together by separating seam 14. Pouches 8 and 10 are thereby isolated from each other by joining seam 12 and separating seam 14. Additional fabric is allowed when forming half the tubular shape in order to allow a larger front pouch 8, for holding the anorak 2. The rear pouch 10 requires no additional fabric because the rear pouch is comprised of no more than the area inherently remaining on the inside of the toroidal shape.

Front pouch 8 is openably sealable by means of a front slide fastener 8*z*, of a type well known in the art, running the upper length of the front pouch. Rear pouch 10 is likewise openably sealable by means of a slide fastener 10*z*, of a type well known in the art, running the upper length of the rear pouch.

Figure 5:
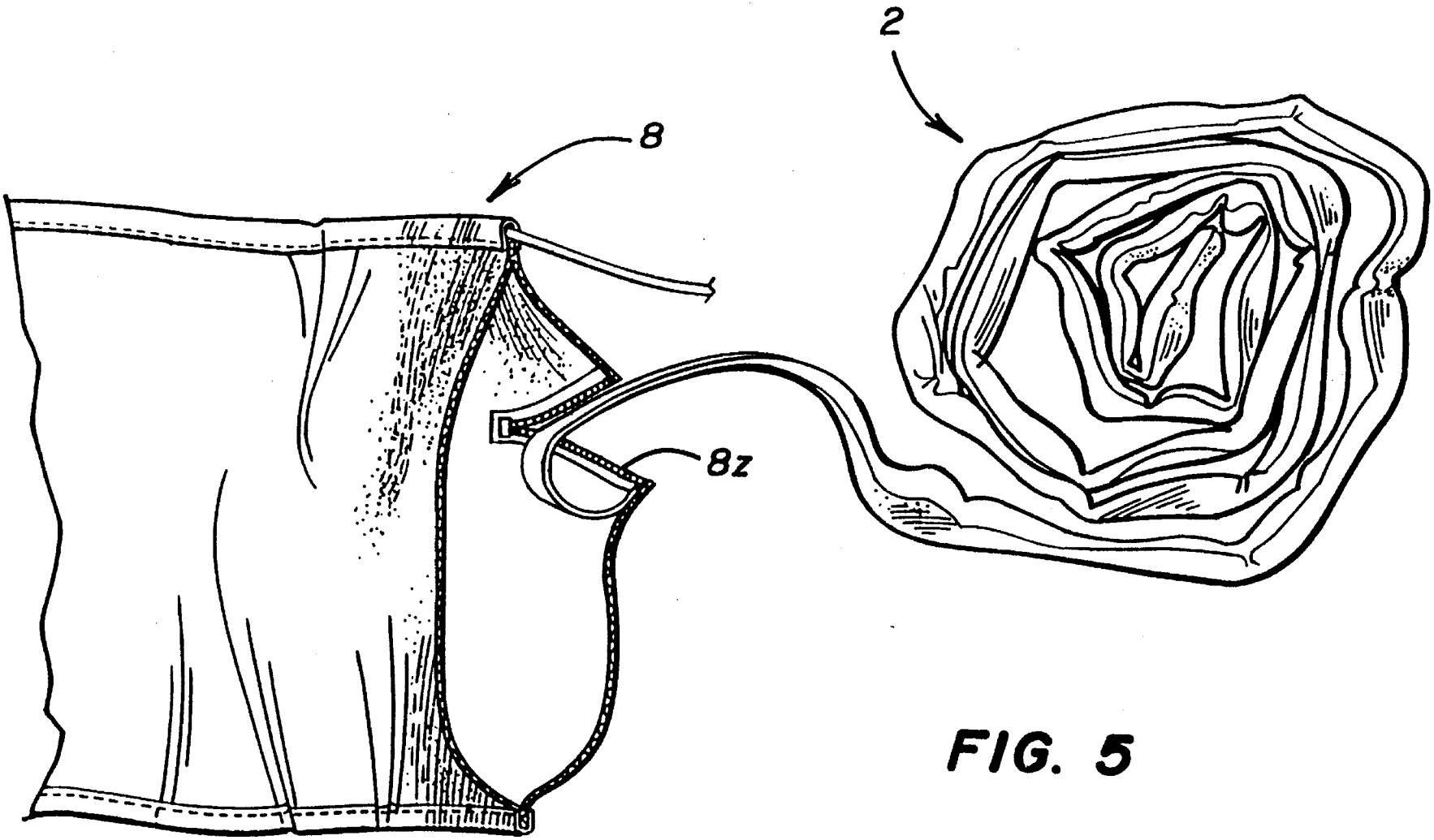
FIG. 5 is a side sectional view of the preferred embodiment, showing the detail of the construction of the anorak front pouch.

Referring now to FIG. 5 the front pouch 8 is attached to the anorak 2 by having the lower front edge of the anorak curve backwardly and sewn just below the lower half of the front slide fastener 8*z*. This configuration is necessary in order to prevent the anorak 2 from catching on front slide fastener 8*z* when it is being stored within the front pouch 8. In addition, with this configuration the anorak 2 will also shield the interior of the front pouch 8 when worn by the user.

Referring once again to FIG. 4, the belt section 6 is cinched to the user's waist in two ways. An elastic band 16, of a type well known in the art, is sewn into a short length of the lower hem at the rear of belt 6 and fabric is bunched over the elastic band. When the user wears the belt about his waist, the elastic expands and maintains tension on the user's waist, thereby preventing the pouch from bouncing from the walking movement of the user. Additionally, a belt lanyard 18, a cord, runs continuously through a hem formed along the upper perimeter of belt section 6. Each end of the belt lanyard 18 emerges through holes 20*a* and 20*b* on one side of the belt section 6. The holes 20*a* and 20*b* are best reinforced with steel eyelets to prevent the belt lanyard 18 from tearing the fabric when cinched. A single plastic, spring-actuated self-locking toggle 22, of a type well known in the art, rides on both of the free ends of the belt lanyard 18 extending outside of the holes. The user pulls on the belt lanyard ends to cinch the lanyard, then slides the toggle 22 towards that user's waist, allowing the toggle to lock the belt section 6 about the waist.

The anorak 2 is made from an anorak front section (shown as 24 in FIG. 6) and an anorak back section 26. The anorak front section is cut in a fashion typical for the front section of common tee shirts, a pattern well known in the art, having semicircular upper edges formed for later sewing to left sleeve 28*a* right sleeve 28*b* and, further, collar in FIG. 6).

Figure 6:
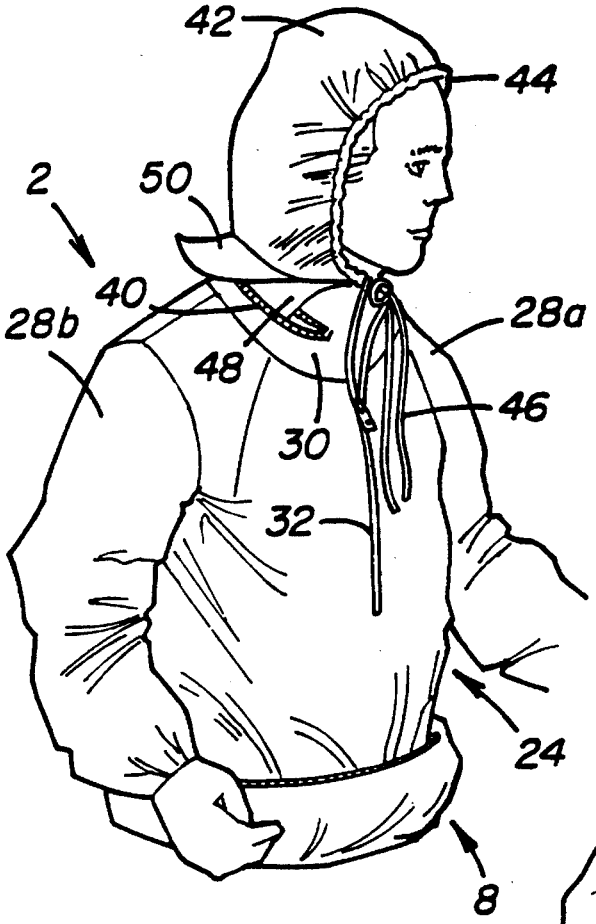
FIG. 6 is a side view of the preferred embodiment of the invention being worn by the user, showing the detail of the hood.

Referring now to FIG. 6, The anorak front section 24 is split downwardly about twelve inches from the center of the semicircular edge formed for the collar 30, being open at the neck of the user; the two sides of the split are openably joined by a front section slide fastener 32. This allows the user to fit his head though the collar even though he may be wearing a bicycle or motorcycle helmet, then to attain a tighter fit of the anorak front section 24 after closing the slide fastener.

Referring again to FIG. 4, the anorak back section 26 is similarly cut in a fashion typical for the back section of common tee shirts, a pattern well known in the art, in that it has semi-circular edges formed for later sewing to sleeves 28*a* and 28*b* and a collar 30. The pattern differs from the common tee shirt back section pattern however, in that the back section 26 is large enough to additionally cover some or all of a backpack which the user could be carrying. The vertical sides of the anorak back section 26 are sewn to the vertical sides of the anorak front section. The anorak 2 has sleeves for covering the length of the user's arms, left sleeve 28*a* and right sleeve 28*b*, sewn to both the front section 24 and back section 26. Each sleeve has an elasticized cord or ribbon sewn into the cuff, 28*ax* and 28*bx* respectively, to prevent water from entering the anorak by way of the cuffs.

Figure 7:
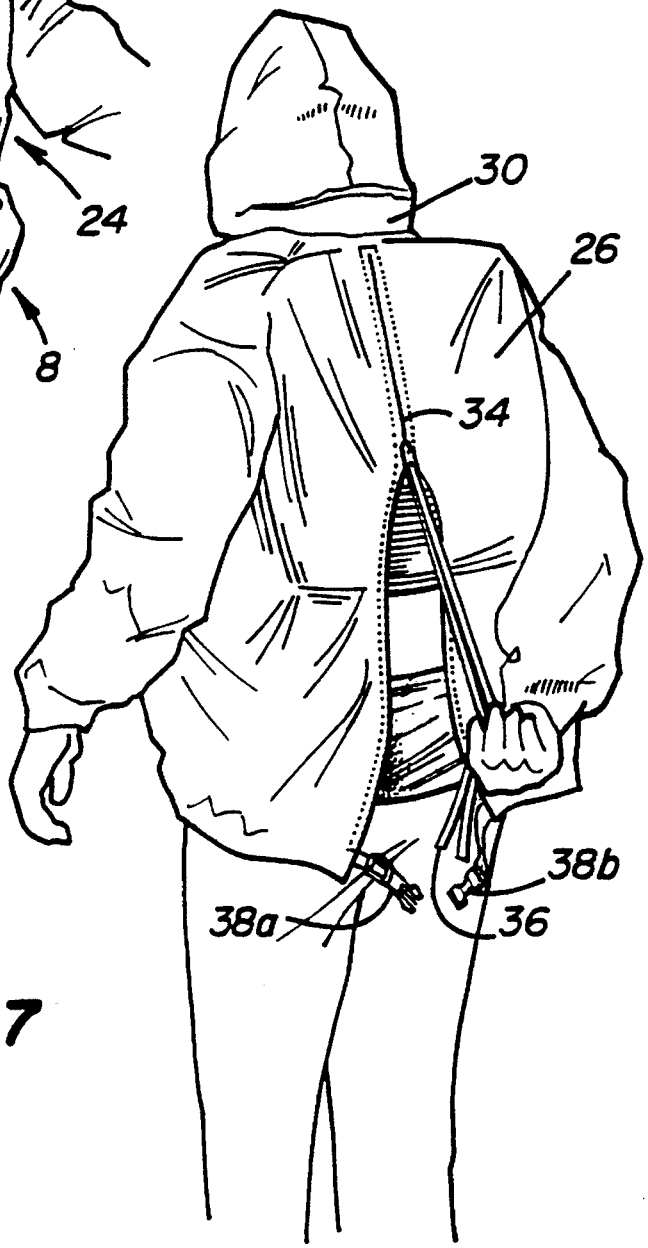
FIG. 7 is a rear view of a figure wearing the preferred embodiment of the invention and closing it down the back.
Figure 8:
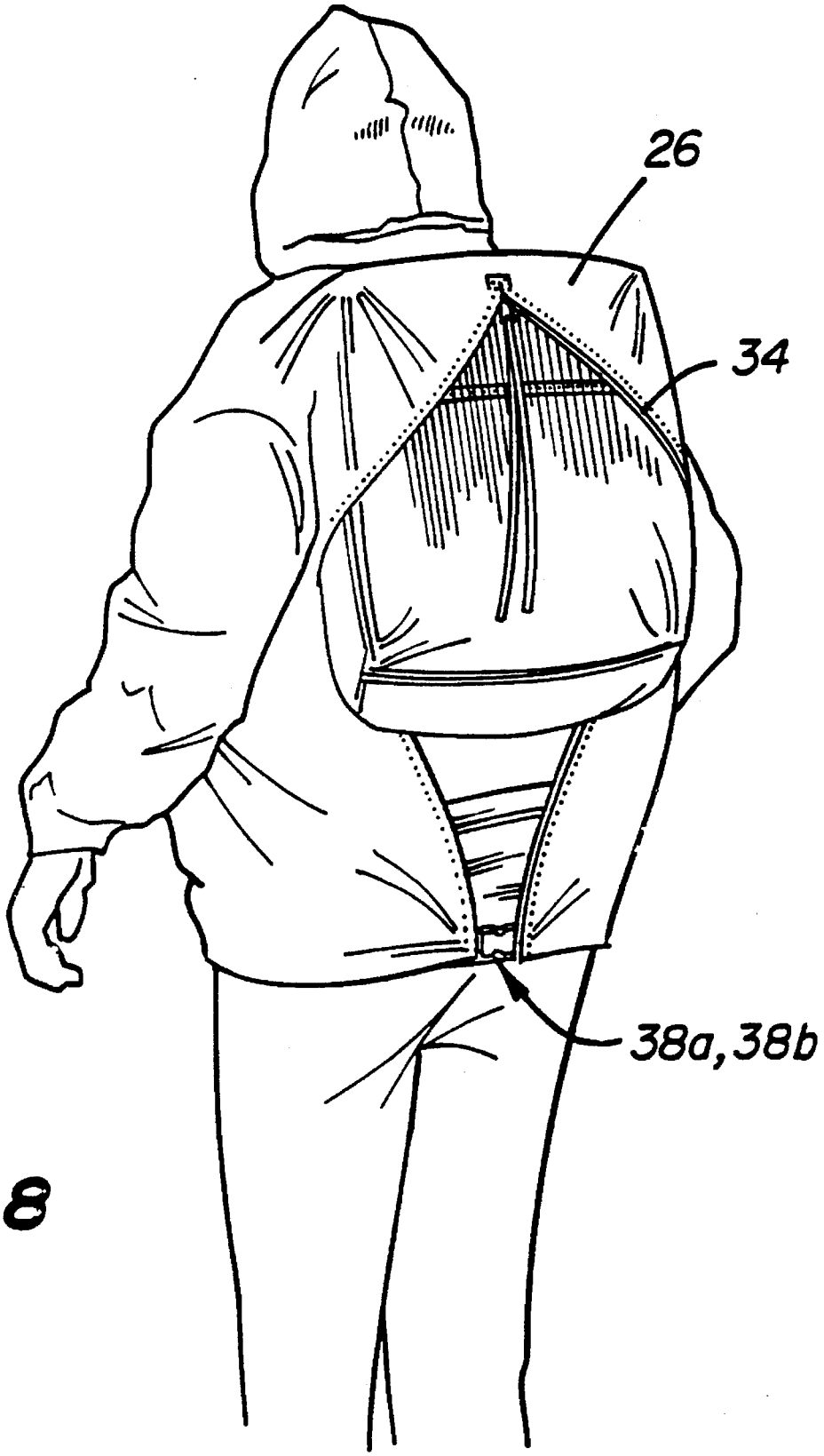
FIG. 8 is a rear view of a figure wearing the preferred embodiment of the invention, using the clasp to secure the invention over an oversized backpack.
Figure 9:
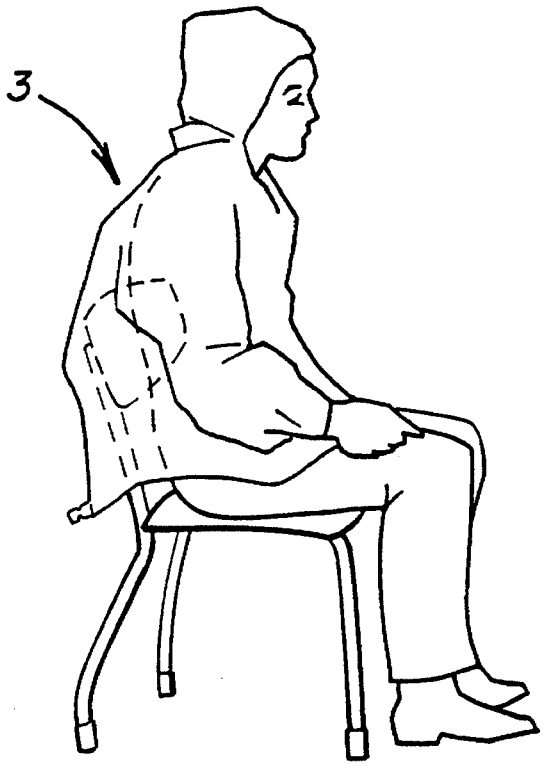
FIG. 9 is a side view of a figure wearing the preferred embodiment while seated.
Figure 10:
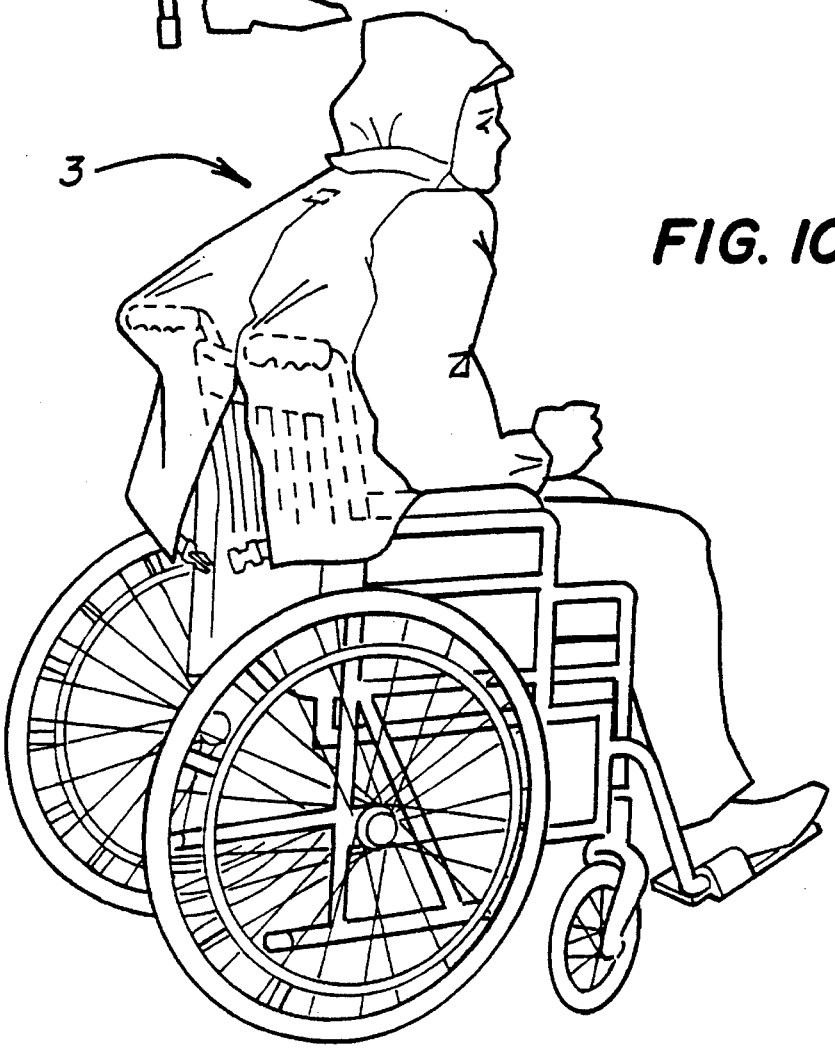
FIG. 10 is a side view of a figure wearing the preferred embodiment while seated in a wheelchair.

Referring now to FIG. 7, the anorak back section 26 is further split in the middle, open from the lower edge up to almost the upper edge just below the semicircular edge formed to be sewn to the collar 30, being open at the lower edge. The two sides of the split are openably joined by the anorak back section slide fastener 34. The slide fastener 34 should not be of the locking type. A lanyard 36, preferably a ribbon of about nine inches in length, is attached to the pull tab of the slide fastener 34 by means of a simple knot. With this design the user can easily pull the anorak 2 over both his head and the backpack, then close the anorak back section 26 snugly over the backpack by reaching behind himself and pulling downwardly on the lanyard Referring now to FIG. 8, mated clasp halves 38*a* and 38*b* (which are more clearly depicted in FIG. 4) are attached at the lower end of the back section slide fastener 34. A plastic mated clasp half, of a type well known in the art, is attached to either side of back section slide fastener 34. If the pack is too large for the back section 26 to cover, it will allow the user to at least clasp the lower edge of the anorak together around the pack without closing the slide fastener.

Referring now once again to FIG. 6, the collar 30 forms a pouch made from a single rectangular piece of fabric folded over on itself and sewn lengthwise. The collar surrounds the user's neck, being sewn along its lower edge to the top of the front section 24, divided by slide fastener 32, to the sleeves 28*a* and 28*b* and to the upper end of anorak back section 26 (as shown in FIG. 4).

The collar 30 has a slide fastener 40 running along the length of the collar in the back, distal the neck of the user. In this manner the collar 30 forms an openably sealable pouch. A hood 42 is contained in the pouch. The user opens the collar slide fastener 40, and withdraws the hood 42 to put over his head.

The hood 42 itself is formed from two pieces of fabric 42*a* and 42*b* (shown in FIG. 4) sewn together from front to back, forming a bag with an open edge at the user's face 44. This open edge is continuously hemmed through sides 42*a* and 42*b* and a hood lanyard 46, a cord, passes through the hem, having the ends dangling freely about nine inches on either side. To cinch the hood tightly about the user's face, the user pulls on the ends of the hood lanyard 46 and ties them together with a simple bow knot.

The hood is connected to the inside of the collar pouch by means of a rectangular piece of material, the hood connecting tab 48 (also shown in FIG. 4). The hood connecting tab is sewn along its length to the inside of the pouch formed by the collar 30, just under the lower half of the collar pouch slide fastener 40. The remaining lengthwise side of the hood connecting tab 48 is sewn at the center of the rear of the hood 42, about three inches from the lower edge of the hood. Sewing the hood connecting tab 48 to the hood 42 in this fashion creates an overlapping piece, the hood apron 50, which serves to cover the opened pouch formed by the collar 30 and thereby keep moisture from entering the pouch.

The preferred fabric for all of the fabric portions of the invention is nylon having a plasticized coating applied to the sides of the fabric which are interior when the anorak is donned by the user.

Alternative Embodiment

As was mentioned earlier, alternative embodiments of the invention are possible. Referring now to FIG. 3, the covering garment 3 shown is a common poncho, a covering garment well known in the art, which is a substantially rectangular piece of fabric with a hole in approximately the center for the user's head to pass through. The front of the poncho is attached to the inside of the front pouch The opening of front pouch 52 should be openably sealable and can be made so by means of a slide fastener, a hook and loop configuration, buttons, hooks or the like, all methods which are well known in the art. This prevents the covering garment 3 from spilling out of the pouch 52 when it is stored within the pouch and protects the stored covering garment from the elements.

Again, the method of using the invention is simple and straightforward. The backpacker wears the front pouch 52 to the front, opens the front pouch and removes the covering garment 3 through the mouth of the pouch. The backpacker then raises the covering garment 3 over his head and, if he is wearing one, the backpack too, and dons the covering garment. Because the covering garment is stored in front of the backpacker, there is no need to first remove a backpack in order to don the covering garment. Similarly, because the covering garment is stored in the pouch at front of a seated person, the user can easily don the garment without having to first stand up or uncomfortably contort himself order to don the covering garment. The covering garment 3 itself can alternatively be any of a multitude of garment configurations, such as a poncho, wind breaker or rain slicker.

A wide variety of fabrics commonly used in garments can be used to form the covering garment 3, other parts of the invention, and the anorak ( in FIG. 4) such as cotton, nylon, orlon, rayon, Goretex® (Polytetrafluoroethylene fabric), silk or wool. If the fabric used is not inherently water-repellant, it can additionally be coated with a water repellant of a kind well known in the art, such as a rubber, silicone or plastic coating. The covering garment 3 can be attached to pouch 52, by means of sewing, gluing or taping, or other methods of joining material, all of which are methods well known in the art.

What is claimed is:

1. A garment for easy deployment, comprising:

a) a belt section formed to be worn around a person's waist having a front pouch and means for opening and closing said front pouch;

b) an anorak having a front section, a back section, sleeves and a collar;

c) said front section being sewn to said front pouch, to said back section, to said sleeves, and to said collar;

d) said back section including a closeable split for separating said back section into two parts, said back section being sewn to said sleeves and to said collar.

2. The garment according to claim 1, wherein said collar forms a closeable pouch having a hood therein, and wherein said hood is sewn to said pouch.

3. The garment according to claim 2 wherein said hood includes a connecting tab, and wherein said hood is sewn to said connecting tab and said connecting tab is sewn to said pouch formed by said collar.

4. The garment according to claim 1, wherein the means for opening and closing said front pouch is a slide fastener.

5. The garment according to claim 1, wherein said anorak is of sufficient size to cover both a portion of the person and a portion of a backpack being worn by the person.

6. The garment according to claim 1, wherein said belt section includes a rear pouch and means for opening and closing said rear pouch.

7. A method for allowing a person to easily don a covering garment including a closeable split in the back section of the covering garment comprising the steps of:

a) storing a covering garment at the front of the person on a belt worn on the person's waist, wherein said covering garment is attached to said belt;

b) removing the covering garment from storage and placing it over the person;

c) closing the split in the back section of the covering garment.

8. The method of claim 7 wherein the person carries a backpack on his back and including the step of covering a portion of the backpack with the covering garment.

9. The method of claim 7 wherein the person is seated on a chair and including the step of covering a portion of the chair with the covering garment.

10. The method of claim 7 wherein the person is seated on a wheelchair and including the step of covering at least part of said wheelchair with the covering garment.

11. A garment for easy deployment comprising:

a) a belt section formed to be worn around a person's waist having a front pouch;

b) a covering garment of sufficient size to cover a portion of the person, said covering garment being stored within said front pouch and attached thereto; and c) said covering garment including a closeable split in the back section of the covering garment.

12. The garment of claim 11 wherein the covering garment is also of sufficient size to cover both a portion of the person and a portion of a backpack being worn by the person.

13. The garment of claim 11 further comprising a collar for surrounding the neck of the person, and wherein the collar further forms a pouch containing a hood.

* * * * *